United States Patent [19]

Zoueki

[11] Patent Number: 5,024,516

[45] Date of Patent: Jun. 18, 1991

[54] OPHTALMIC APPARATUS

[76] Inventor: Georges Zoueki, 4812 Verdun, Verdun, Quebec, Canada, H4G 1N1

[21] Appl. No.: 379,001

[22] Filed: Jul. 12, 1989

Related U.S. Application Data

[63] Continuation-in-part of Ser. No. 246,330, Sep. 19, 1988, abandoned.

[51] Int. Cl.[5] ..... G02C 7/08; G02C 1/00

[52] U.S. Cl. ..... 351/57; 351/41; 351/158

[58] Field of Search ..... 351/41, 59, 60, 123, 351/124, 158; 350/146

[56] References Cited

FOREIGN PATENT DOCUMENTS 441647 8/1967 Switzerland .

*Primary Examiner*—Rodney B. Bovernick

*Attorney, Agent, or Firm*—Robic

[57] ABSTRACT

There is disclosed an apparatus capable of holding a pair of lenses in front of a mirror, in order to help a person having a poor vision to proceed adequately to make-up her eyes. This apparatus comprises a support comprising a T-shaped member on the cross arm of which a pair of spaced lens carriers are mounted. A pair of opthalmic lenses are mounted on the carriers to fit the viewer's eyes. The support is detachably connectable to the mirror by way of a suction-cup or any other mechanical attachment, to lie in a common plane parallel to the mirror.

13 Claims, 3 Drawing Sheets

FIG. 5
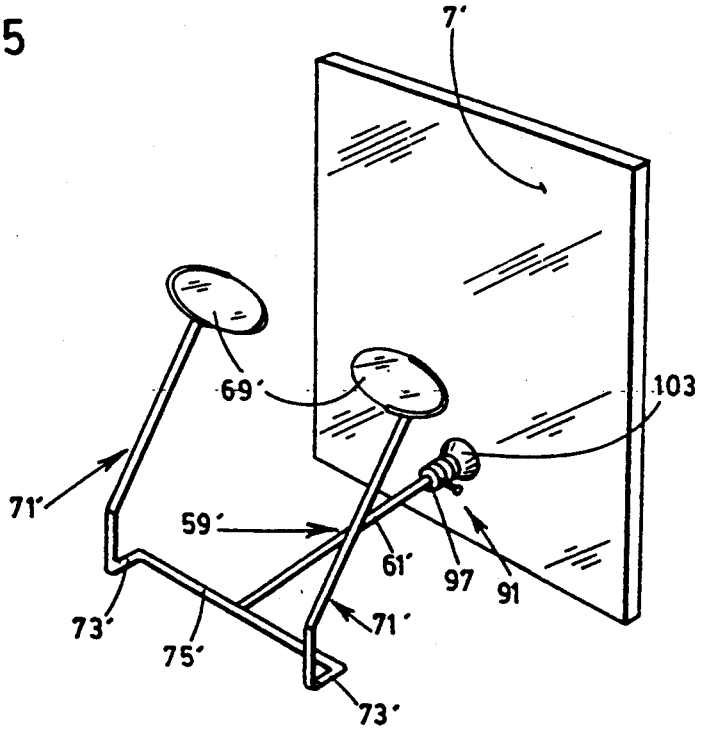
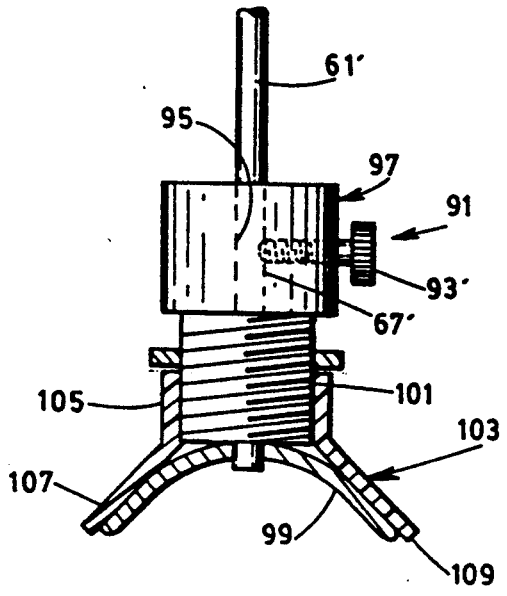
FIG. 7

OPHTALMIC APPARATUS

CROSS-REFERENCE

This application is a continuation-in-part of application Ser. No. 246,330 filed on Sept. 19, 1988 now abandoned.

BACKGROUND OF THE INVENTION

1. Field of the invention

The present invention relates to an opthalmic apparatus for use to help a person having a poor vision, to proceed adequately to make-up her eyes.

2. Description of the prior art

A major problem met by people, especially women having a poor vision is to make-up their eyes adequately. The problem affects most women over 45, and is also applicable to actors with faulty vision. To applicant's knowledge, the only solution that has been proposed to solve this problem is to provide make-up frames having opthalmic lenses pivotably mounted to free one eye and then the other during the make-up.

SUMMARY OF THE INVENTION

An object of the invention therefore lies in providing an apparatus suitable to solve the above problems. In principle, the invention lies in an apparatus which is capable of holding and adjusting a pair of lenses in front of a mirror, the lens prescription corresponding approximately or exactly to that required for eye-glass frame try-outs or for make-up.

More specifically, the invention provides an apparatus for holding a pair of lenses in front of a mirror, comprising:

- a support comprising a T-shaped member having a longitudinal arm and a cross arm, and a pair of spaced-apart lens carriers mounted onto said cross-arm;
- a pair of opthalmic lenses mounted on said lens carriers to fit viewer's eyes and
- means for mounting the longitudinal arm of the T-shaped member of the support onto the mirror in such a manner that the opthalmic lenses lie in a common plane in front of, and parallel to, said mirror.

In accordance with a preferred embodiment of the invention, the lens carriers are straight bars projecting away from said cross arm in front of said mirror, said lenses being carried by said straight bars at the ends thereof away from said cross arm. Means may also be provided for adjusting the distance between said spaced lenses while holding said lenses in said common plane, said lens distance-adjusting means comprising means for mounting the lens carriers on said cross arm and allowing said carriers to be displaced lengthwise along the cross arm of said T-shaped member in order to adjust the distance between said lenses.

In accordance with another preferred embodiment of the invention, each one of said lens carriers is essentially a right-angular bar assembly comprising:

- a first straight bar connected at one end to said cross arm;
- a second straight bar having one of said lenses at the free end thereof, and
- hinge means allowing pivoting of said second bar between a first position wherein said lens stands in said common plane and a second position wherein said second bar is pivoted out of said common plane.

The means for mounting the longitudinal arm of the T-shaped member onto the mirror preferably comprise a suction-cup device attachable to the mirror and including means for preventing said longitudinal arm from wobbling with respect to said mirror.

Other objects and advantages of the invention will become apparent to those skilled in the art from the following description having reference to the appended drawings.

BRIEF DESCRIPTION OF THE DRAWINGS

FIG. 5 is a perspective view of another apparatus made according to the invention for use to make-up eyes;

FIG. 7 appearing on the same sheet of drawings as FIG. 5, is a side elevational view of another suction-cup device that can be used with the apparatus shown in FIG. 5.

DESCRIPTION OF THE PREFERRED EMBODIMENTS

Figure 4:
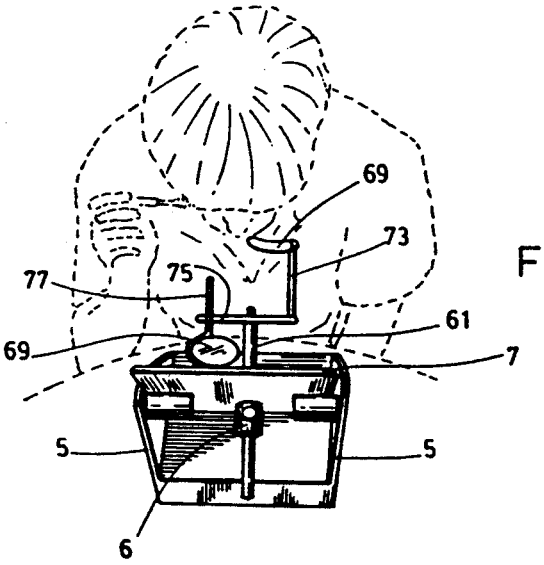
FIG. 4 is a top plan view of the apparatus shown in FIG. 1, in use.

The apparatus shown in FIGS. 1 to 4 is intended for use by a woman to make-up her eyes.

In this embodiment, the lens support 59 is located at the lower end of the mirror 7. It has a T-shaped structure and comprises a longitudinal arm 61 perpendicular to the mirror 7 and a cross arm 75 normal to the arm 61 and thus parallel to the mirror. The longitudinal arm 61 of the support slides through a hole 63 of the mirror 7 and its backing plate 13 as well as through a bore of a bearing block 65 fixed to the backing plate. The longitudinal arm 61 has, at that end, a flat 67 and a knob 68 is driven against it to hold the support 59 non-rotatably on the mirror and with the lenses 69 it supports at the appropriate distance from the mirror, this distance being adjustable in the same manner.

The lenses 69 are carried and held normally parallel to the mirror, by a pair of generally right-angular bar assemblies 71 each made up of a first straight bar 73 connected at one end to one end of the cross arm 75, and of a second straight bar 77 to the free end of which one lens 69 is secured. Since the apparatus is adapted for one particular person only, the prescription of the lenses may be exact and the second arm unremovably joined with the first arm 73.

Figure 2:
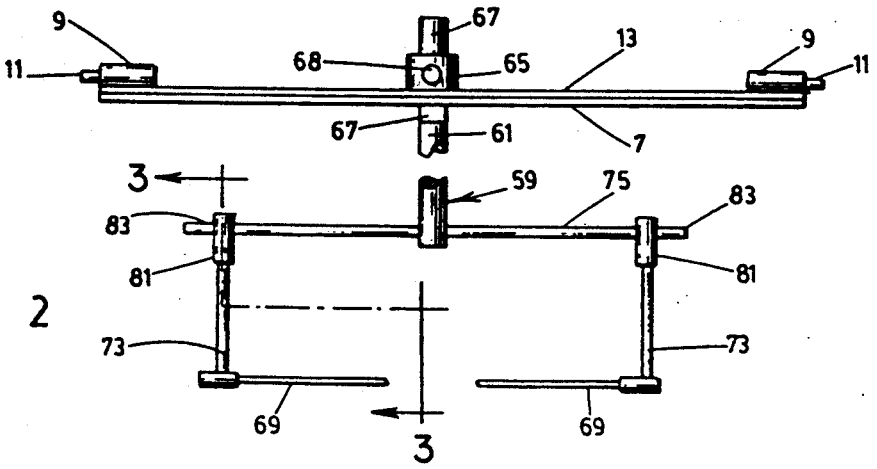
FIG. 2 is a top plan view of the mirror and lens support assembly.

For connecting the cross arm 75 and the first bars 73 together, the latter have transverse through holes 79, preferably in enlargements 81 thereof (FIG. 2). The cross arm 75 has end flats 83 parallel to the mirror 7 and slid across the holes 79. The bar assemblies 71 are secured to the cross arm 75 by set screws 85 that are applied against the flats 83 and clamp the assemblies 71 to the cross arm 75 with the second arm 77 and lenses 69 held parallel to the mirror 7.

Figure 1:
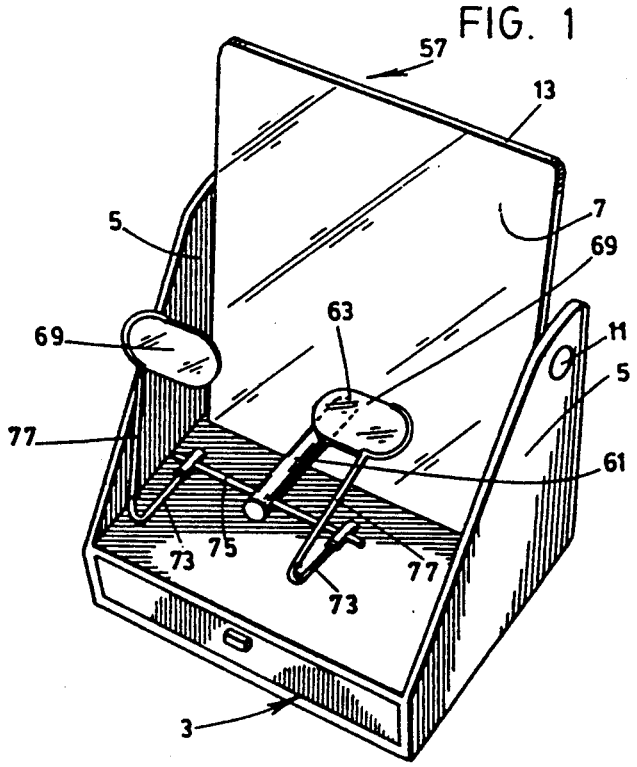
FIG. 1 is a perspective view of an apparatus made according to the invention for use to make-up eyes.
Figure 3:
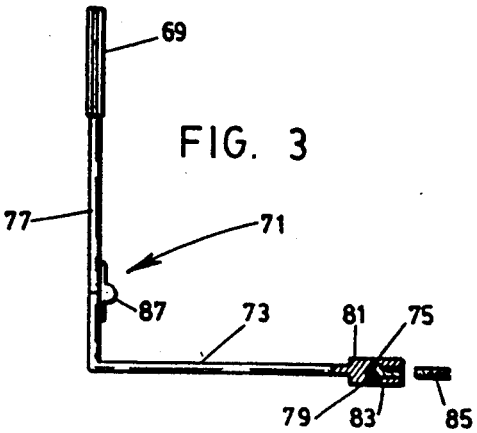
FIG. 3 is a view taken along line IV—IV of FIG. 1.

The lower ends of the second bars 77 are each provided with a hinge 87 (FIG. 3) capable of allowing the two bars 77 and their lenses 69 to be moved between a first "normal" position, wherein the lenses 69 stand in their common plane and are essentially parallel to the mirror 7, and a second position wherein one of the two bars is pivoted out of the common plane toward the mirror, as is the case with the right-ward bar 77 and lens 69 in FIG. 1. The hinge 87 may be of the spring-ball type like the one known under the trade mark SFEROFLEX, capable of releasably locking in the aforesaid two position. With this arrangement, make-up of one eye can be achieved by folding the relevant lens 69 while looking into the mirror through the other lens.

In this case, the lenses 69 may be set into proper and final position by the dispensing optician himself for the specific person for whom the apparatus is adapted and the lenses are accordingly to the person's exact prescription, as aforesaid.

In order to afford as much space as possible between the bar assemblies 71 so that the user may freely position his face between them, the lenses 69 may be made narrow, rectangular and rounded edged, as shown, allowing the bar assemblies to be moved further apart while still permitting the same spacing between the lenses.

The apparatus shown in FIG. 5 is a variant of the one shown in FIG. 1. This variant is intended to be used by a woman who is accustomed to make-up her eyes in front of a given mirror inside her house or apartment and does not want to buy a whole kit as shown in FIG. 1.

Figure 6A:
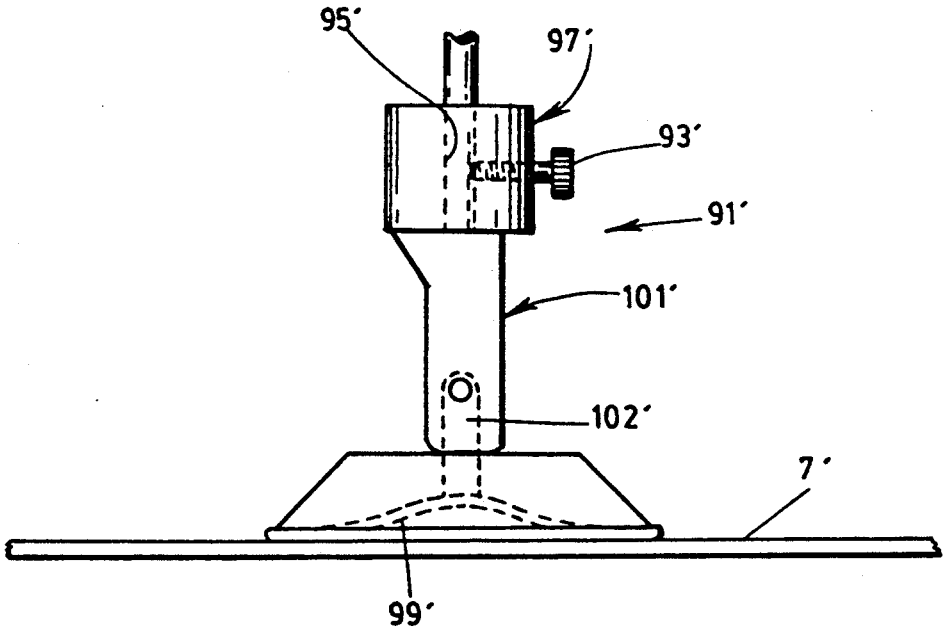
FIGS. 6*a* and 6*b* are side elevational views of a suction-cup device that can be used with the apparatus shown in FIG. 5, is inoperative and operative position, respectively.
Figure 6B:
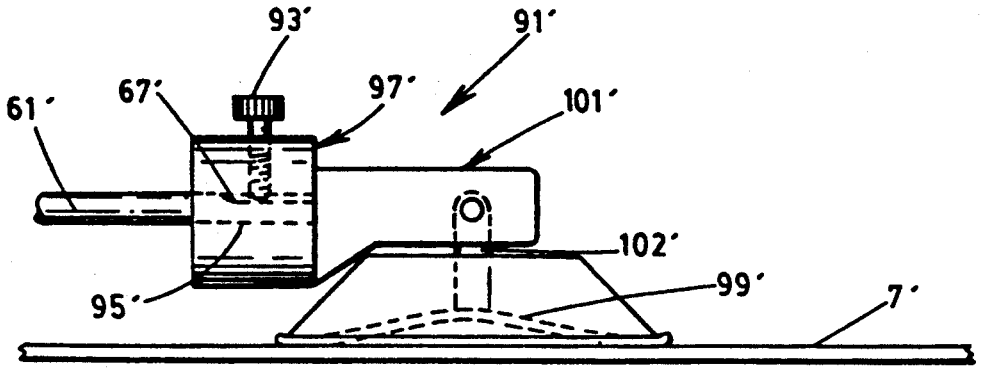

In this embodiment, the lens support 59' has a T-shaped structure and comprises a longitudinal arm 61' and a cross-arm 75' normal to the arm 61. Instead of being slidally mounted into a hole provided in a mirror especially provided and designed for this purpose, the longitudinal arm 61' is detachably fixable on any mirror 7' by means of a suction-cup device 91 (as shown in FIG. 7) or 91' (as shown in FIGS. 6*a* and 6*b*), acting as lens support mounting means.

The longitudinal arm 61' has at its "free" end, a flat 67'. A knob 93 (or 93') intersects a longitudinal hole 95 (or 95') provided in a bearing block 97 (or 97') forming part of the device 91 (or 91'). This knob is driven against this flat 67' to fix non-rotatably the support 59' on the mirror 71 with the lenses 69' it supports at a predetermined but not adjustable distance from the mirror.

The lenses 69' are carried and held normally parallel to the mirror by a pair of generally right-angular bar assembly 71' similar is structure, operation and use to those shown in FIG. 1, except that their first straight bars 73' integrally extend from the opposite ends of the cross bar 75' and they are not laterally adjustable with respect to each other.

Of course, the width between the lenses 69' must be predetermined to fit a great majority of people, or to be adapted to every prescription, as are the opthalmic lenses per se.

As shown in FIG. 7, the suction-cup device 91 may comprise a suction-cup 99 made of rubber material, that is centraly fixed to a rigid threaded peg 101 integrally projecting from the block 97 opposite to the hole 95. To prevent the longitudinal arm 61' and thus the support 59' and lenses 99, from wobbling, use can be made of means consisting of a small, funnel-shaped body 103 of rigid plastic having a cylindrical portion 105 slidably mounted onto the peg 101 and a conical portion 107 whose larger base 109 is sized to bar onto the mirror outwardly of the suction cup 99 and thus "stabilize" the device 91 and support 59' connected thereto. A nut is screwed on the threaded peg 101 to lock the same relative to the body 103 and thus keep the suction-cup 99 in fixing position.

As shown in FIGS. 6*a* and 6*b*, the suction-cup device 91' may alternatively comprise a suction-cup 99' made of rubber, that is centrally fixed to a short arm 102' pivotably mounted at the end of a peg 101' integrally projecting from the block 97' opposite to the hole 95'.

The cup is covered by a rigid plastic cap 103' which is designed to be pushed against the mirror by some camming effect when the block 97' and peg 101' are moved from the position shown in FIG. 10*a* to the one shown in FIG. 10*b*. This structure and the way it works to prevent wobbling are already known in the act and have not to be disclosed in further detailed.

In all cases, the use of such suction-cups devices 91, 91' makes it possible to fix the support 59' and its attached lenses 69' to any mirror, thereby making the "kit" useful without having to buy and/or use a built-in mirror as shown in FIGS. 1 to 4.

What is claimed is:

1. An apparatus for holding a pair of lenses in front of a mirror, comprising:

a support comprising a T-shaped member having a longitudinal arm and a cross arm, and a pair of spaced-apart lens carriers mounted onto said cross-arm;

a pair of opthalmic lenses mounted on said lens carriers to fit viewer's eyes and means for mounting the longitudinal arm of the T-shaped member of the support onto the mirror in such a manner that the opthalmic lenses lie in a common plane in front of, and parallel to, said mirror.

2. An apparatus as claimed in claim 1, wherein said lens carriers are straight bars projecting away from said cross arm in front of said mirror, said lenses being carried by said straight bars at the ends thereof away from said cross arm.

3. An apparatus as claimed in claim 2, further comprising:

means for adjusting the distance between said spaced lenses while holding said lenses in said common plane, said lens distance-adjusting means comprising means for mounting the lens carriers on said cross arm and allowing said carriers to be displaced lengthwise along the cross arm of said T-shaped member in order to adjust the distance between said lenses.

4. An apparatus as claimed in claim 3, wherein the longitudinal arm of said T-shaped member has a flat at the end thereof away from said lenses, and wherein means for mounting the longitudinal arm of the T-shaped member onto the mirror comprise:

a bearing block fixed to said mirror and having a bearing bore perpendicular to said mirror, said longitudinal arm extending through said bore, screw means, on said bearing block, including a knob screw pressed against said flat for holding said lenses at a selected distance from said mirror and non-rotatably about the longitudinal axis of said longitudinal arm, and whereby said support may be adjustably displaced in a to-and-fro motion with respect to said mirror with said lenses held essentially parallel to said mirror.

5. An apparatus as claimed in claim 4, wherein said mirror has a bottom edge and a hole therethrough adjacent said bottom edge, and wherein said bearing block is fixed to said mirror with said bearing bore axial with said hole.

6. An apparatus as claimed in claim 3, further comprising a base having a pair of spaced upright walls, and pivot means mounting said mirror on and between said walls for selective inclination of said mirror.

7. An apparatus as claimed in claim 6, wherein said mirror has a bottom edge and a hole therethrough adjacent said bottom edge, and wherein said bearing block is fixed to said mirror with said bearing bore coaxial with said hole.

8. An apparatus as claimed in claim 2, wherein said means for mounting the longitudinal arm of the T-shaped member onto the mirror comprises a suction-cup device attachable to the mirror and including means for preventing said longitudinal arm from wobbling with respect to said mirror.

9. An apparatus as claimed in claim 1, wherein each one of said lens carriers is essentially a right-angular bar assembly comprising:

a first straight bar connected at one end to said cross arm;

a second straight bar having one of said lenses at the free end thereof, and hinge means allowing pivoting of said second bar between a first position wherein said lens stands in said common plane and a second position wherein said second bar is pivoted out of said common plane.

10. An apparatus as claimed in claim 9, wherein each of said first bars has a transverse in its connection end and said carrier mounting means comprise:

a flat formed at each end of said cross arm, said flat ends extending across said first bar holes, and screw means, on said first bars, including screws threaded into axial tapped bores of said connection ends of said first bars and being pressed against said flats, constructed so that said first bars and hence said right angular bar assemblies are non-rotatably secured to said cross arm with said lenses parallel to said mirror, in selected positions therealong.

11. An apparatus as claimed in claim 9, wherein the longitudinal arm of said T-shaped member has a flat at the end thereof away from said lenses, and wherein means for mounting the longitudinal arm of the T-shaped member onto the mirror comprise:

a bearing block fixed to said mirror and having a bearing bore perpendicular to said mirror, said longitudinal arm extending through said bore, screw means, on said bearing block, including a knob screw pressed against said flat for holding said lenses at a selected distance from said mirror and non-rotatably about the longitudinal axis of said longitudinal arm, and whereby said support may be adjustably displaced in a to-and-fro motion with respect to said mirror with said lenses held essentially parallel to said mirror.

12. An apparatus as claimed in claim 11, wherein said mirror has a bottom edge and a hole therethrough adjacent said bottom edge, and wherein said bearing block is fixed to said mirror with said bearing bore coaxial with said hole.

13. An apparatus as claimed in claim 9, wherein said means for mounting the longitudinal arm of the T-shaped member onto the mirror comprises a suction-cup device attachable to the mirror and including means for preventing said longitudinal arm from wobbling with respect to said mirror.

* * * * *